US006909355B2

(12) United States Patent
Hashimoto et al.

(10) Patent No.: US 6,909,355 B2
(45) Date of Patent: Jun. 21, 2005

(54) ILLUMINATION-TYPE ROTARY VARIABLE RESISTOR

(75) Inventors: Yukio Hashimoto, Okayama (JP); Seiki Miura, Okayama (JP)

(73) Assignee: Matsushita Electric Industrial Co., Ltd.,, Osaka (JP)

( * ) Notice: Subject to any disclaimer, the term of this patent is extended or adjusted under 35 U.S.C. 154(b) by 0 days.

(21) Appl. No.: 10/800,933

(22) Filed: Mar. 15, 2004

(65) Prior Publication Data

US 2004/0227613 A1 Nov. 18, 2004

(30) Foreign Application Priority Data

Mar. 18, 2003 (JP) ..... 2003-073845

(51) Int. Cl.[7] ..... H01C 10/00
(52) U.S. Cl. ..... 338/196; 338/162
(58) Field of Search ..... 338/196, 162

(56) References Cited

FOREIGN PATENT DOCUMENTS

JP 2-55411 * 2/1990 ..... 338/60

JP 2001-305259 10/2001

* cited by examiner

*Primary Examiner*—Karl D. Easthom
(74) *Attorney, Agent, or Firm*—RatnerPrestia

(57) ABSTRACT

An illumination-type rotary variable resistor. A housing includes a round bottom plate, a cylindrical outer wall protruding in a first direction, and a cylinder. This housing houses an annular insulating substrate having a resistor film and LED conductive film on its surface facing in the first direction. An operating knob includes a cylindrical operating member rotatably fitted to the cylinder and a flange having a resistor slider and LED slider on a face in a second direction being opposite to the first direction. The operating member has a through hole along the first direction, and the flange is attached to the operating member in the second direction. A cover covers the housing and flange. A surface-mount LED is disposed in the through hole at an end which is facing in the second direction. A resistor slider slides on the resistor film, and a LED slider slides on the LED conductive film.

8 Claims, 11 Drawing Sheets

ILLUMINATION-TYPE ROTARY VARIABLE RESISTOR

BACKGROUND OF THE INVENTION

1. Field of the Invention

The present invention relates to illumination-type rotary variable resistors used for controlling the temperature and wind direction of car air conditioners and the sound volume and quality of video and audio equipment.

2. Background Art

Rotary variable resistors with an annular cross section are commonly used as equipment controls. The increasing sophistication of equipment and the trend for centralization of operating units have led to building switches and other electronic components into rotary variable resistors and mounting them on equipment wiring boards.

Concerning rotary variable resistors, illumination-type rotary variable resistors which have a light-emitting diode (LED) built into the operating unit are increasingly used. The LED is built in to indicate the position to which the resistor has been rotated when in use.

An LED built-in rotary variable resistor is described next as a conventional illumination-type rotary variable resistor, with reference to FIGS. 9 to 12.

FIG. 9 is a side sectional view, FIG. 10 is an exploded perspective view, FIG. 11 is a sectional view of a key part showing a section taken along Line 11—11 in FIG. 10 in its center portion, and FIG. 12 is a plan view illustrating the relation of an insulating substrate and slider which are key parts of the conventional rotary variable resistor with built-in LED.

In FIGS. 9 to 12, housing 1 has an approximately round center hole 1A at its center. Housing 1 is an insulating resin housing with an annular cross section.

A wall surrounding center hole 1A protrudes upward to form cylinder 1B.

An annular portion of housing 1 is cavity with an open top. In other words, cylinder 1B, round bottom plate 1C, and outer wall 1D create cavity 1E.

Annular insulating substrate 2 is housed and held in cavity 1E.

LED conductive film 3 including anode conductive film 3A and cathode conductive film 3B are printed to be formed on a top face of insulating substrate 2 at the inner radius.

Resistor film 4 including resistance film 4A and conductive film 4B are concentrically printed to be formed on insulating substrate 2 at the outer radius of LED conductive film 3.

Terminal 5 for coupling to an outer electrical circuit (not illustrated) of the illumination-type rotary variable resistor is connected to the end of each film.

Insulated resin operating knob 6 has flange 6B on its outer radius beneath cylindrical operating member 6A. An inner face of operating member 6A is fitted in rotatable fashion to an outer face of cylinder 1B of housing 1.

When operating member 6A and cylinder 1B are fitted together, flange 6B is housed in cavity 1E of housing 1. Resistor slider 7 which resiliently contacts and slides on resistor film 4, and anode slider 8 and cathode slider 9 which resiliently contacts and slides on LED conductive film 3 are provided on the bottom face of flange 6B.

The top face of operating knob 6 assembled in rotatable fashion on housing 1 as described is supported by cover 10.

This cover 10 is attached in a way such as to cover cavity 1E of housing 1 containing flange 6B.

Cylindrical operating member 6A and cylinder 1B of housing 1 protrude upward from center hole 10A in cover 10.

As shown in FIG. 10, spring member 14 is attached to cover 10. Spring member 14 has retainer 14B at its center. This retainer 14B engages tooth 6G created on flange 6B of operating knob 6. Retainer 14B is pressed against tooth 6G by springs 14A on both its sides. This allows operating knob 6 to be held reliably at the rotated position to maintain the set resistance.

As shown in FIGS. 10 and 11, LED through hole 6C is created such as to pass vertically through in a radial thickness of cylindrical operating member 6A of operating knob 6.

A portion of anode slider 8 perpendicularly bent upward is further processed to create dogleg LED contact 8B. In the same way, a portion of cathode slider 9 perpendicularly bent upward is further processed to create dogleg contact 9B.

LED contact 8B and LED contact 9B are inserted into LED through hole 6C in such a way that these contacts 8B and 9B face each other inside LED through hole 6C. Projection 6D provided on a bottom face of flange 6B is flattened and deformed such as to secure anode slider 8 and cathode slider 9. In this way, anode slider 8 and cathode slider 9 are fixed to the bottom face of flange 6B.

LED 11 is inserted from the top into LED through hole 6C in operating member 6A. Bottom ends of two LED terminals 11A, the anode and cathode of LED 11, are cut at a bevel to a predetermined length from the end so as to form a sharp point at each tip. These two LED terminals 11A bend the top of dogleg LED contacts 8B and 9B, and resiliently contact anode slider 8 and cathode slider 9.

LED conductive film 3 and resistor film 4 are disposed on annular insulating substrate 2.

FIG. 12 shows further details of substrate 2. Cathode conductive film 3B and anode conductive film 3A are disposed as LED conductive film 3, and conductive film 4B and resistance film 4A are printed to be formed as resistor film 4 in these sequences from the inner radius.

Each film is annular, with the same center, and disposed electrically insulated from each other.

Anode slider 8 has conductive film contact 8A whose tip is split into two contacts and which slides on anode conductive film 3A. Contact 8A extends away from the insertion position of LED 11 in the direction opposite to the circumferential direction of LED contact 8B.

Cathode slider 9 has conductive film contact 9A whose tip is split into two contacts and which slides on cathode conductive film 3B. Contact 9A extends away from the insertion position of LED 11 to the direction opposite to the circumferential direction of LED contact 9B.

Resistor slider 7 has conductive film contact 7A whose tip is split into two contacts and resistance film contact 7B whose tip is split into three contacts. Each contact resiliently contacts and slides on conductive film 4B and resistance film 4A.

Conductive film contact 7A and resistance film contact 7B resiliently contact conductive film 4B and resistance film 4A respectively at radially aligned positions.

In the above configuration, resistor slider 7 slides on resistance film 4A and conductive film 4B when operating knob 6 is rotated so that a predetermined resistance is gained from electrically coupled terminal 5.

LED 11 emits light when powered by the current passing between anode conductive film 3A and cathode conductive film 3B through anode slider 8 and cathode slider 9 so as to clearly indicate the operating position of operating knob 6.

One known prior technical document related to the conventional illumination-type rotary variable resistor described above is the Japanese Laid-open Application No. 2001-305259.

This conventional illumination-type rotary variable resistor provides a dogleg bend on LED contacts 8B and 9B of LED sliders 8 and 9. In addition, LED sliders 8 and 9 are bent approximately perpendicularly to the attachment face that is the bottom face of flange 6B.

Furthermore, LED contacts 8B and 9B are inserted and fixed to LED 11 through hole 6C in operating knob 6 in a way not to deform contacts 8B and 9B when attaching LED sliders 8 and 9.

With respect to workability, the above processing and attachment are not always efficient.

In addition, it is often preferable to cut the tip of LED terminal 11A at a bevel before inserting LED 11. This is because a beveled tip makes it easy to bend dogleg LED contacts 8B and 9B of LED sliders 8 and 9 using two LED terminals 11A when LED 11 is inserted into LED through hole 6C in operating knob 6.

SUMMARY OF THE INVENTION

The present invention offers an illumination-type rotary variable resistor with stable quality that demonstrates good placement and attachment workability for a light-emitting diode (LED) and LED slider.

The illumination-type rotary variable resistor of the present invention is configured as below.

(a) A housing includes a round bottom plate, cylinder, and cylindrical outer wall.

The cylinder is attached to an inner radius of the bottom plate, and protrudes in the first direction along its center axis.

The cylindrical outer wall surrounds the bottom plate, and protrudes in the first direction.

(b) An annular insulating substrate is housed in the housing facing the bottom plate. A resistor film and light-emitting diode (LED) conductive film are disposed on the surface of the insulating substrate facing in the first direction.

(c) An insulating resin operating knob has a cylindrical operating member and flange.

The operating member has a through hole passing through in the first direction, and is fitted in rotatable fashion around the outer radius of the cylinder.

The flange is attached to the operating member at the side of the second direction that is the direction opposite to that of the first direction. A resistor slider and LED slider are disposed on the flange at a face facing in the second direction.

(d) A cover is attached to the housing, and covers the flange.

(e) A surface-mount LED is fitted in a through hole at the end in the second direction.

In the above resistor, the resistor slider resiliently contacts and slides on the resistor film. The first contact of the LED slider resiliently contacts an electrode of the surface-mount LED. A second contact of the LED slider slidably and resiliently contacts the LED conductive film.

The above configuration allows fitting of the surface-mount LED to the bottom end of the LED through hole provided on the cylindrical operating member of the operating knob, i.e., the end facing in the second direction. Still more, the contact of the LED slider resiliently contacts the electrode on the bottom face of the LED by fixing the LED slider on the bottom face of the flange of the operating knob. This eliminates the need for preparatory work to cut the LED terminal, and facilitates attachment of the LED and LED slider. The present invention thus offers the illumination-type rotary variable resistor with reliable quality and fewer assembly steps.

DETAILED DESCRIPTION OF THE INVENTION

A preferred embodiment of the present invention is described next with reference to FIGS. 1 to 8.

Figure 1:
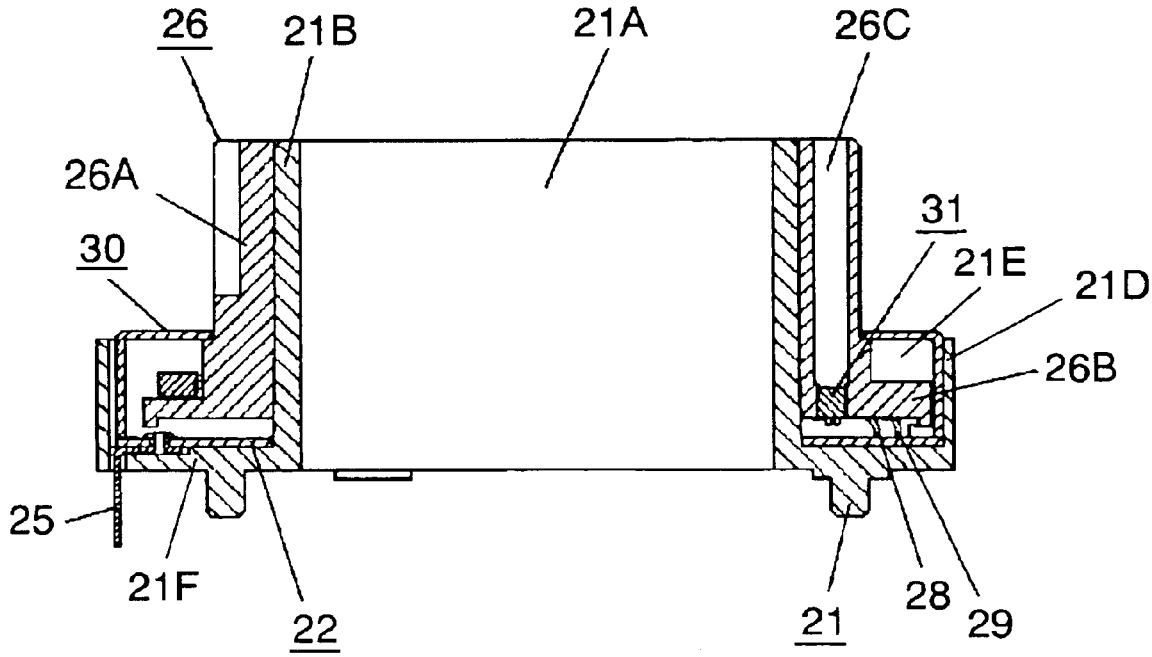
FIG. 1 is a side sectional view of a rotary variable resistor with a built-in LED, which is an illumination-type rotary variable resistor in accordance with a preferred embodiment of the present invention.

FIG. 1 is a side sectional view of a rotary variable resistor with a built-in light-emitting diode (LED), which is an illumination-type rotary variable resistor in the preferred embodiment of the present invention.

Figure 2:
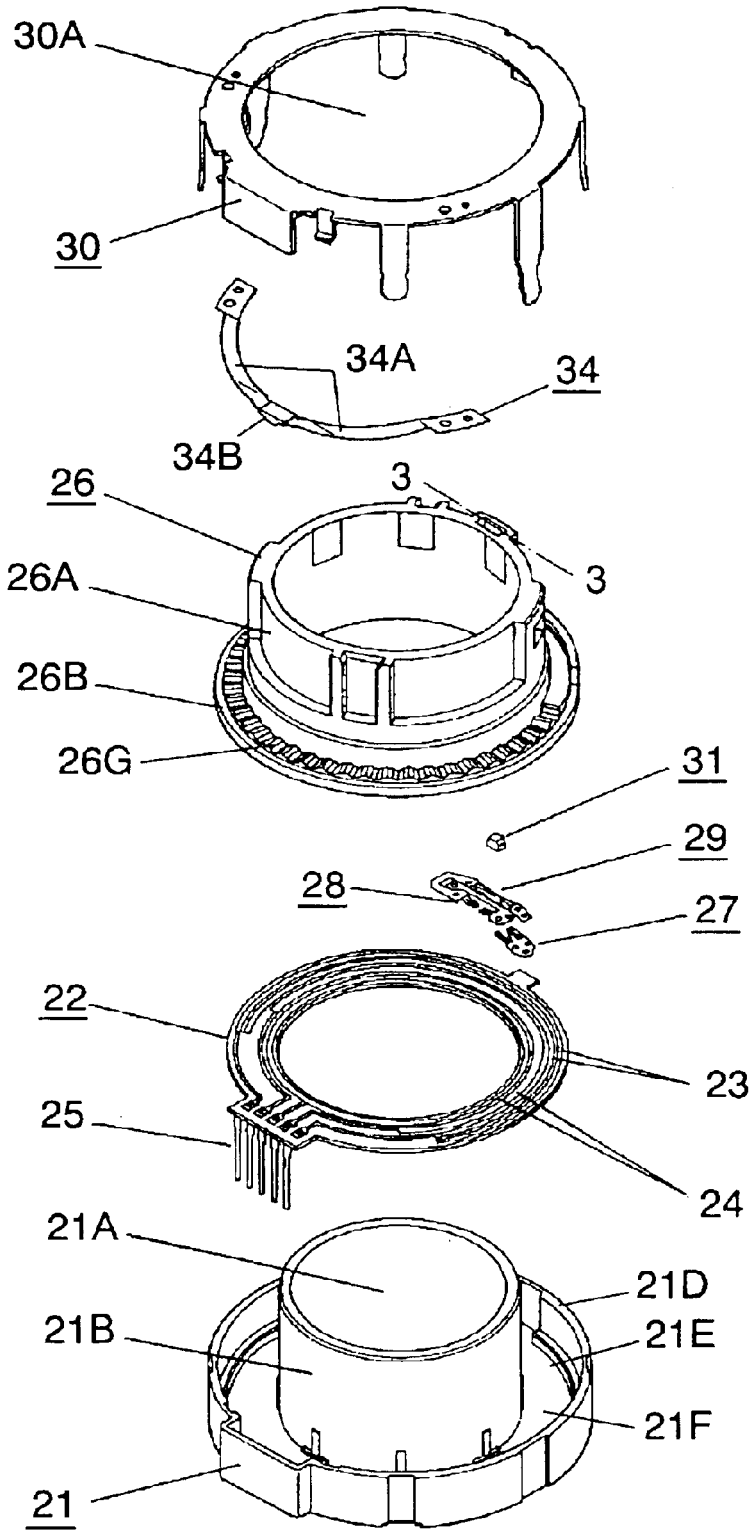
FIG. 2 is an exploded perspective view of the illumination-type rotary variable resistor in accordance with the preferred embodiment of the present invention.

FIG. 2 is an exploded perspective view of the illumination-type rotary variable resistor in the preferred embodiment of the present invention.

Figure 3:
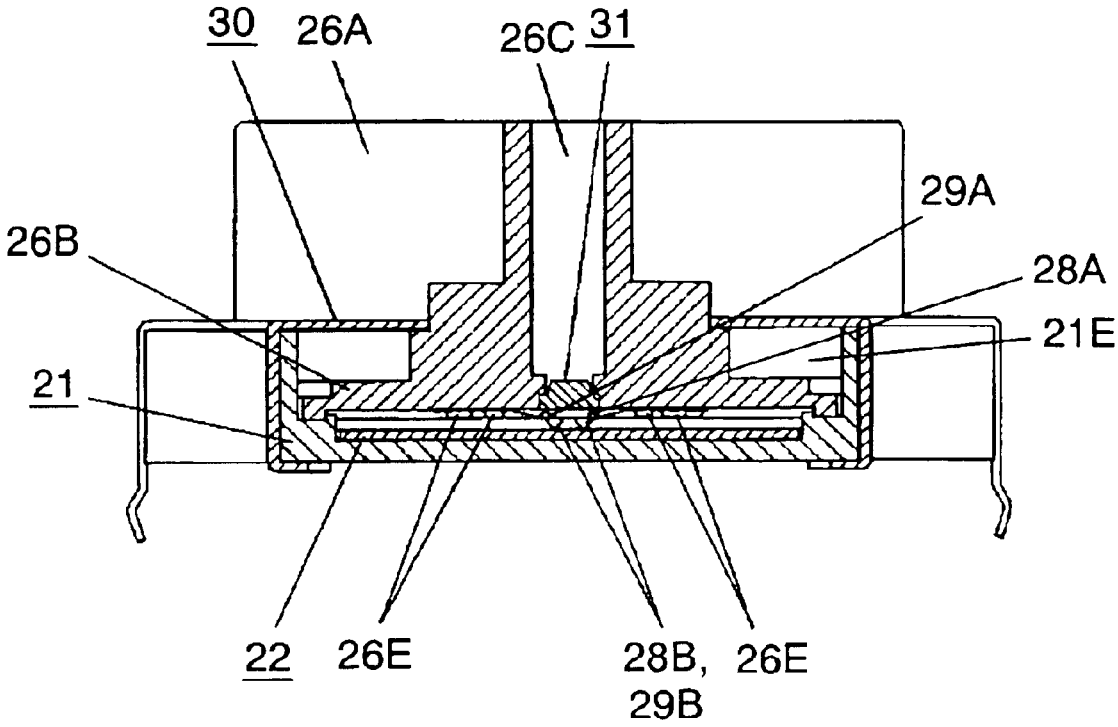
FIG. 3 is a sectional view of a key part of the illumination-type rotary variable resistor in accordance with the preferred embodiment of the present invention, which shows a section taken along Line 3—3 in FIG. 2 in its center portion.

FIG. 3 is a sectional view of a key part centering on a section taken along Line 3—3 in FIG. 2 of the illumination-type rotary variable resistor in the preferred embodiment of the present invention and its surrounding area.

In FIGS. 1, 2, and 3, housing 21 has round center hole 21A at its center, and thus a cross section of the outline of housing 21 is annular. Housing 21 can also be made of an insulating resin. Cylinder 21B protrudes upward, which is the first direction parallel to its center axis, and surrounds center hole 21A. Cylindrical outer wall 21D protruding upward, round bottom plate 21F, and cylinder 21B form cavity 21E with an open top face.

Annular insulating substrate 22 is housed in housing 21 such as to face bottom plate 21F on the bottom of cavity 21E. LED conductive film 23 and resistor film 24 are printed to be formed in annular shapes, having the same center respectively, on the top face of insulating substrate 22, which is facing in the first direction. Ends of films 23 and 24 are coupled to terminals corresponding to terminals 25.

Operating knob 26 includes cylindrical operating member 26A and flange 26B. This flange 26B is formed on the bottom, which is a part toward a second direction opposite to the first direction, of operating member 26A, and protrudes outside operating member 26A. The inner face of operating member 26A rotatably fits with the outer face of cylinder 21B.

Operating knob 26 and housing 21 are assembled so as to house flange 26B inside cavity 21E of housing 21. Resistor slider 27, anode slider 28, and cathode slider 29 are fixed to the bottom face of flange 26B, which is facing in the second direction. Resistor slider 27 is used for sliding resistor film 24 formed on insulating substrate 22. Anode slider 28 and cathode slider 29 are used for sliding anode conductive film 23A and cathode conductive film 23B of LED conductive film 23.

Cover 30 is attached to housing 21 such as to cover cavity 21E of housing 21. Cylinder 21B of housing 21 and operating member 26A of operating knob 26 protrude upward from center hole 30A in cover 30.

As shown in FIG. 2, spring member 34 is attached to cover 30. This spring member 34 has retainer 34B which engages tooth 26G created on flange 26B of operating knob 26. Retainer 34B is pressed against tooth 26G by springs 34A on both sides. This assures the firm holding of operating knob 26 in the position to which it has been rotated and maintains the set resistance.

As shown in FIGS. 1 and 3, LED through hole 26 is created so as to pass vertically through, i.e., along the first direction, in a radial thickness of operating member 26A. Surface-mount LED 31 is fitted to the bottom end of the LED through hole 26C, which is the end facing in the second direction.

Figure 4A:
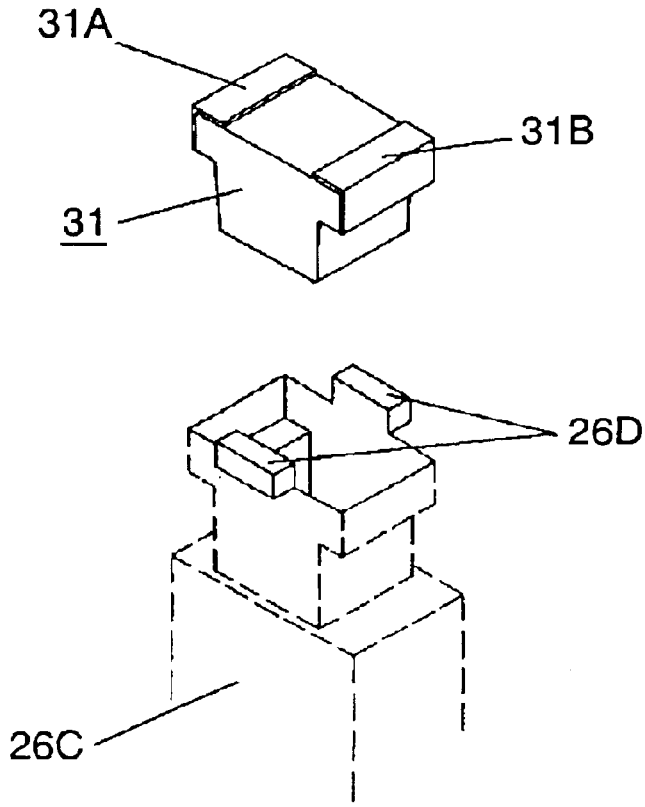
FIGS. 4A and 4B illustrate attachment of a surface-mount LED which is a key part of the illumination-type rotary variable resistor in accordance with the preferred embodiment of the present invention.
Figure 4B:
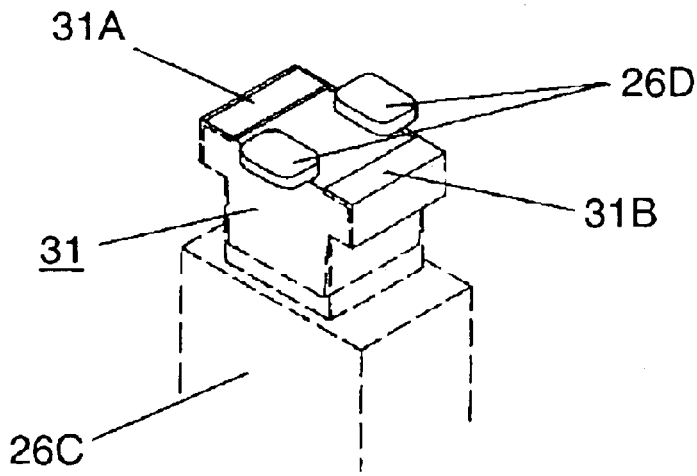

FIGS. 4A and 4B illustrate attachment of the surface-mount LED.

As shown in FIGS. 4A and 4B, the bottom end, i.e., the end facing in the second direction, of the LED through hole 26C is stepped to match the outline of LED 31. LED 31 fitted to a position such that its bottom face, i.e., that facing in the second direction, is approximately level with the bottom face of flange 26B. In addition, protrusions 26D provided on longer sides of an opposing bottom end of LED through hole are flattened and deformed to anchor LED 31 in place.

In this way, the bottom end of LED through hole 26C is stepped to match the outline of LED 31. Surface-mount LED 31 is thus positioned stably without any rattling. Still more, protrusions 26D on the bottom end of LED through hole 26C are flattened and deformed to secure LED 31. This eliminates the need for preparations such as cutting the LED terminal. Moreover, LED 31 can remain firmly in place even if subjected to vibration.

Furthermore, this configuration facilitates automated attachment of LED 31.

Figure 5:
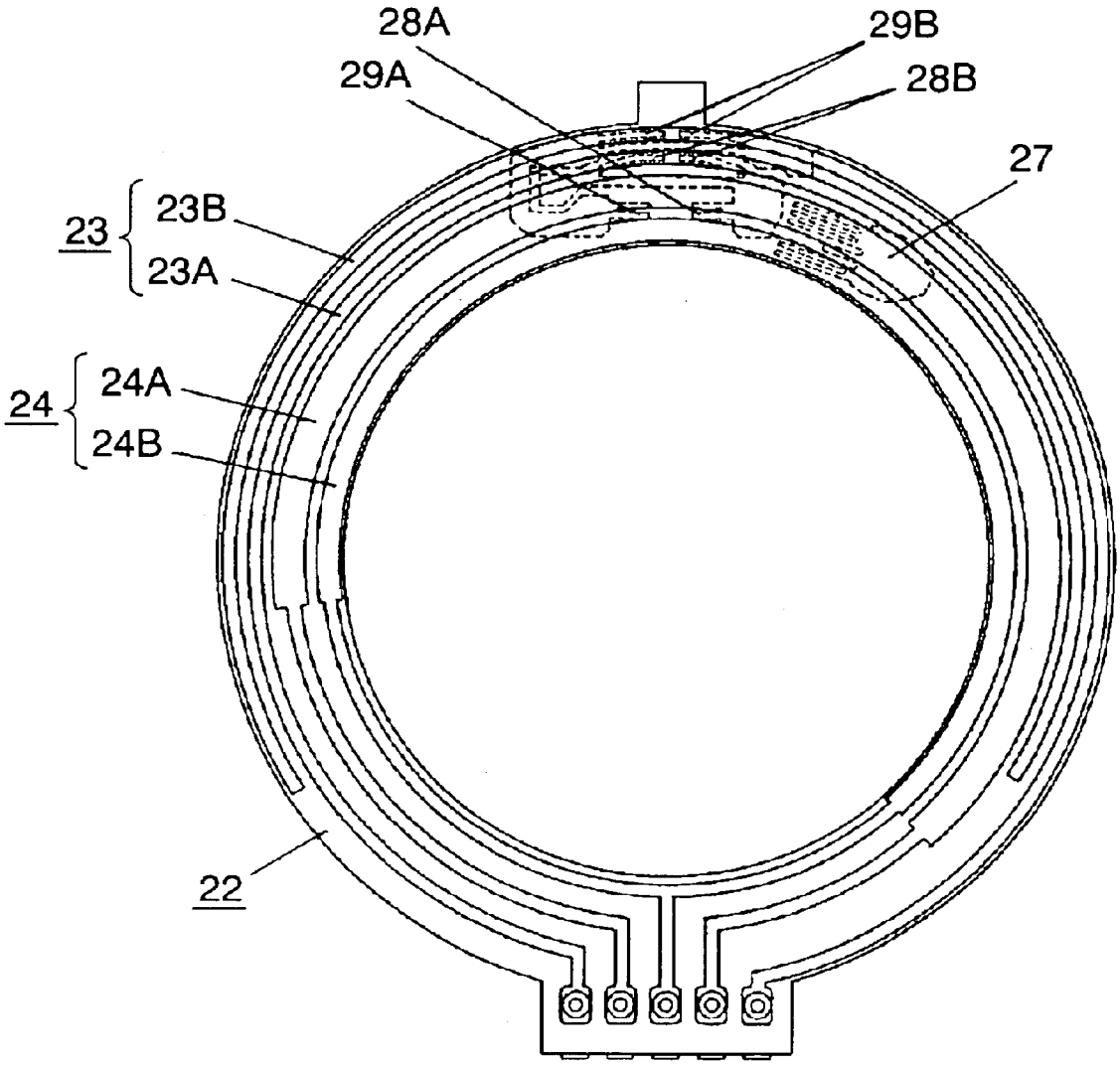
FIG. 5 is a plan view illustrating the relation of an insulating substrate and slider of the illumination-type rotary variable resistor in accordance with the preferred embodiment of the present invention.

FIG. 5 is a plan view illustrating the relation of the insulating substrate and slider.

As shown in FIG. 5, the positional relationship of films formed on annular insulating substrate 22 disposed inside cavity 21E of housing 21 from the center is opposite to that of the conventional configuration described in the Background Art.

More specifically, resistor film 24 includes conductive film 24B formed in the innermost radius and resistance film 24A on its outer radius. LED conductive film 23 is formed on the outer radius of resistor film 24, and includes anode conductive film 23A and cathode conductive film 23B on the outermost radius. Conductive film 24B, resistance film 24A, anode conductive film 23A, and cathode conductive film 23B are printed to be formed concentric to the center axis of cylinder 21B, and are electrically insulated from each other.

Figure 6:
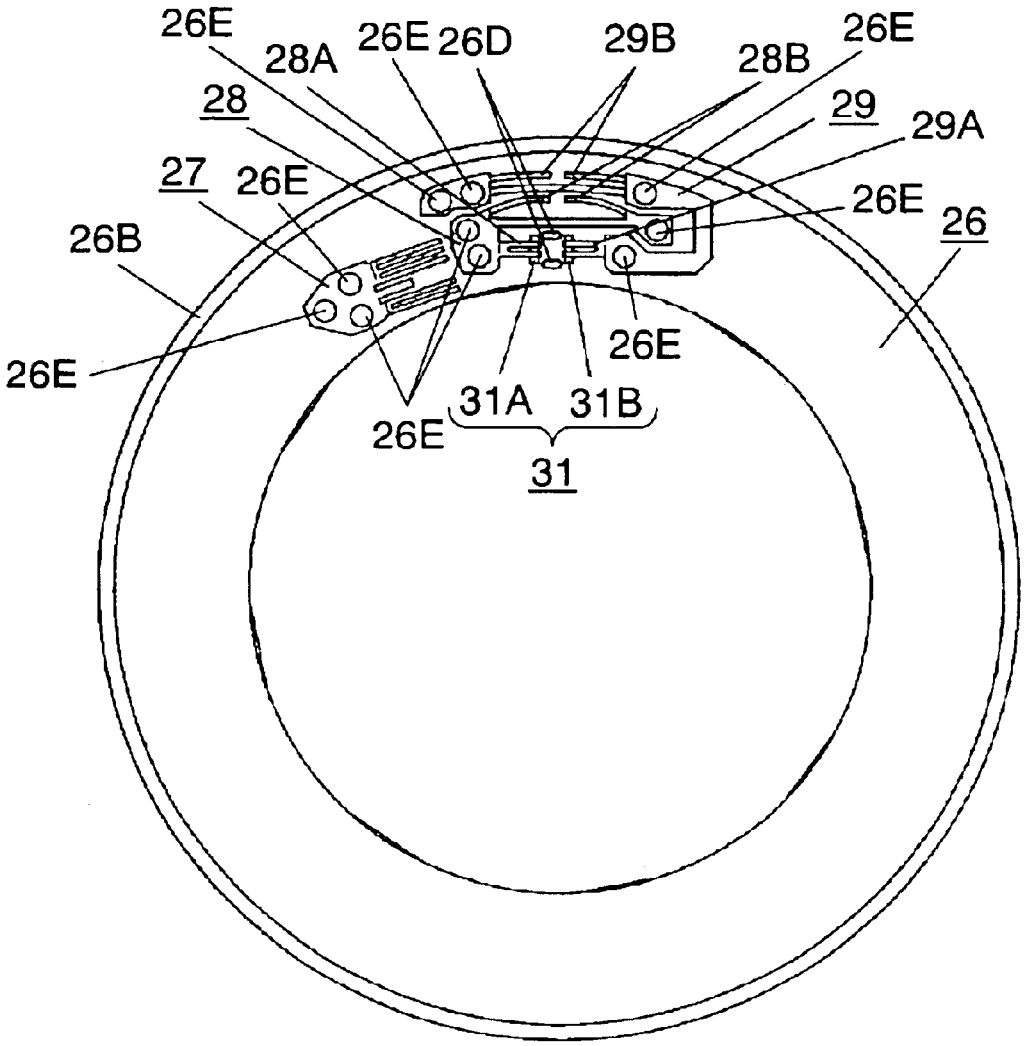
FIG. 6 is a bottom view of an operating knob with fixed slider of the illumination-type rotary variable resistor in accordance with the preferred embodiment of the present invention.

FIG. 6 is a bottom view of the operating knob where sliders are fixed.

As shown in FIG. 6, resistor slider 27, anode slider 28, and cathode slider 29 are attached to the bottom face of flange 26B by flattening and deforming projections 26E on the bottom face of flange 26B.

Anode slider 28 and cathode slider 29 electrically couple LED 31 and LED conductive film 23 on insulating substrate 22.

Anode slider 28 and cathode slider 29 respectively have LED contacts 28A and 29A as the first contact and conductive film contacts 28B and 29B as the second contact.

LED contacts 28A and 29A as the first contact resiliently contact anode electrode 31A and cathode electrode 31B of surface-mount LED 31.

Conductive film contacts 28B and 29B as the second contact slidably and resiliently contact LED conductive films 23A and 23B of insulating substrate 22.

Conductive film contact 28B is formed such that its two arms face each other. Each tip of these two arms is slidably disposed on corresponding anode conductive film 23A on the same circumference.

Conductive film contact 29B is also formed such that its two arms face each other. Each tip of these two arms is slidably disposed on corresponding cathode conductive film 23B on the same circumference.

The tip of each arm can be split into two or more.

The above-described configuration of conductive film contacts 28B and 29B allows sliding of contacts 28B and 29B on anode conductive film 23A and cathode conductive film 23B while maintaining contact at two or more points. The width of anode conductive film 23A and cathode conductive film 23B in the radial direction is the same as when only one contact exists. However, the contact stability of the slider and conductive film is better than when only one contact exists.

In other words, contacts slide on more than one point on the same rotation radius of the LED conductive film so that they can maintain firm contact with the conductive film of the slider. This is because there are two or more contacts, and contacts 28B and 29B contact facing each other. Accordingly, contacts 28B and 29B slide on film 23B and 23A in almost the same contact condition for both clockwise and counterclockwise rotations.

On the other hand, if the contact and film only contacts at one point, the contact condition differs depending on the direction of rotation, failing to achieve stable contact condition.

On the other hand, resistor film 24 includes conductive film 24B and resistance film 24A disposed on the top face of annular insulating substrate 22, which is facing in the first direction. Resistor film 24 is formed on the circles right under the position where LED 31 is fitted. In other words, resistor film 24 is formed annularly centering on the center axis of insulating substrate 22. A cross point of the line passing through hole 26C along the first direction and insulating substrate 22 exists between the inner radius end and outer radius end of resistor film 24.

Resistor slider 27 slides while resiliently contacting conductive film 24B and resistance film 24A. Resistor slider 27 is attached to a deviated rotating circumference to achieve a rotating angle that avoids contacting LED sliders 28 and 29. Resistor film 24 is also printed to be formed on the deviated rotating circumference to conform to this deviated angle.

Resistor slider 27 and LED sliders 28 and 29 are disposed on almost the same circles under LED 31 with the angle deviated in the rotating direction. Accordingly, the size of insulating substrate 22 is not restricted by the size of resistor slider 27 or LED sliders 28 and 29. The outline of insulating substrate 22 can thus be reduced. This enables downsizing the illumination-type variable resistor of the present invention.

In addition, resistor slider 27 can be disposed at an innermost radius on insulating substrate 22. Still more, resistor slider 27, anode slider 28, and cathode slider 29 can be disposed to be aligned in the circumferential direction. This allows reduction of insulating substrate 22 in radial width, enabling downsizing of the variable resistor.

The above configuration also facilitates provision of anode slider 28 and cathode slider 29 close to anode electrode 31A and cathode electrode 31B on the bottom face of surface-mount LED 31, which is facing in the second direction. Accordingly, LED contacts 28A and 29A, which are respectively the first contacts of LED sliders 28 and 29, can be bent upward, i.e., in the first direction, for a shorter length.

On the other hand, anode slider 28 and cathode slider 29, which are respectively the second contacts of the LED slider, are bent downward, i.e., in the second direction, to form conductive film contacts 28B and 29B. As described above, LED contacts 28A and 29A need to be bent only slightly. Accordingly, anode slider 28 and cathode slider 29 can be easily processed even though conductive film contacts 28B and 29B are bent downward and LED contacts 28A and 29A are bent upward. In addition, attachment of anode slider 28 and cathode slider 29 to the bottom face of flange 26B of operating knob 26 can be automated, achieving efficient assembly.

In attaching LED sliders 28 and 29 to operating knob 26, the risk of deforming one of contacts 28A, 29A, 28B, and 29B is also very small. In addition, LED contacts 28A and 29A can be attached resiliently after LED 31 is fixed to anode electrode 31A and cathode electrode 31B, which are the electrodes of surface-mount LED 31 fixed to operating knob 26. Accordingly, LED contacts 28A and 29A firmly contact the LED.

Figure 7:
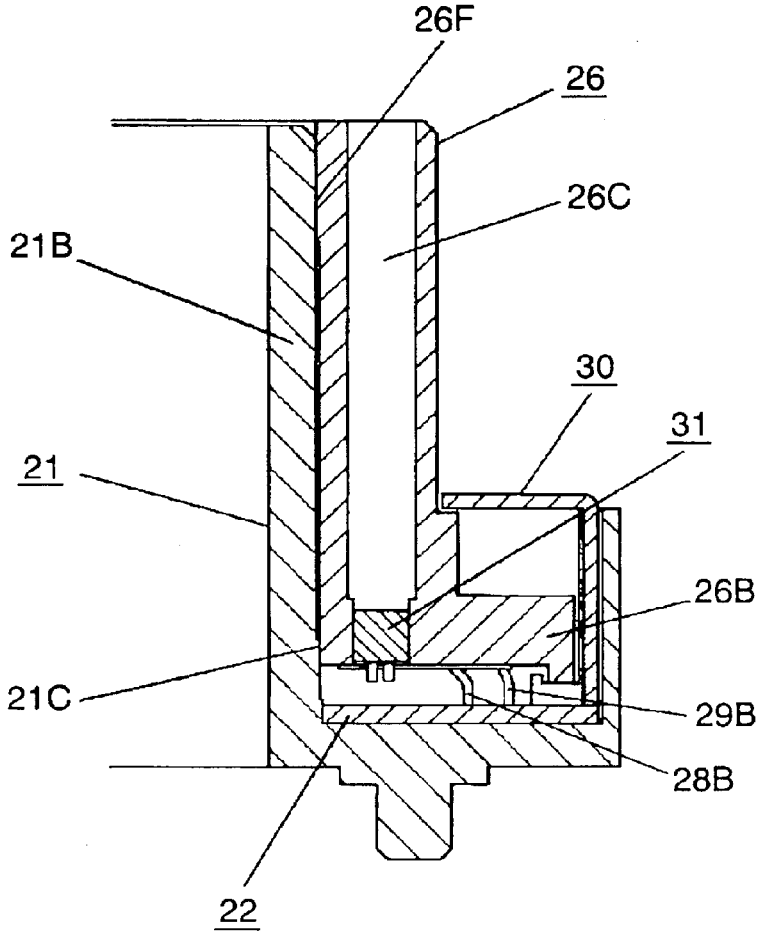
FIG. 7 is a magnified sectional view of a fitted portion of a housing and operating knob of the illumination-type rotary variable resistor in accordance with the preferred embodiment of the present invention.

FIG. 7 is a magnified sectional view of a fitted portion of the housing and the operating knob in the preferred embodiment of the present invention.

As shown in FIG. 7, padding 21C is provided at 8 points, forming equal central angles to the center axis of cylinder 21B, on the outer face of cylinder 21B of housing 21 at the lower part, which is in the second direction side.

The top of padding 21C contacts the inner face of operating knob 26. This contact is roughly a point contact.

Conversely, padding 26F is disposed at 8 points, forming equal central angles to the center axis of operating member 26A, on the inner face of operating member 26A of operating knob 26 at the upper part. Paddings 26F contact the outer face of cylinder 21B of housing 21. This contact is also roughly a point contact.

As described above, paddings 26F and 21C are respectively provided at the upper part of the outer face of cylinder 21B of housing 21 or the inner face of operating knob 26, i.e., in the first direction side, and provided at the lower part of the other sides, i.e. in the second direction side, at positions having equal central angles to the center axis of cylinder 21B. This enables sliding of the fitted portion of cylinder 21B and operating knob 26 in point contact at both upper and lower parts. Accordingly, the present invention offers a rotary variable resistor with good tactile feedback such that the user does not feel any uneven rotation. Rattling of the fitted portion can also be suppressed. The sliding positions of sliders 27, 28, and 29 attached to the bottom face of flange 26B of operating knob 26 are thus unlikely to deviate from positions where resistor film 24 and LED conductive film 23 are printed on insulating substrate 22.

Uneven rotation can be further reduced by providing a longer distance between paddings 21C and 26F by disposing them as far as possible from each other toward the top and bottom ends.

Since both housing 21 and operating knob 26 are cylindrical, distortion often occurs at the fitted portion due to shrinkage of resin after molding. Accordingly, dies for molding housing 21 and operating knob 26 are adjusted in some cases to prevent the occurrence of distortion. In the preferred embodiment, paddings 21C and 26F are provided on housing 21 and operating knob 26. Accordingly, only a portion of the die for molding paddings 21C and 26F needs to be corrected when adjusting the die. The operation required for correction is thus easily implemented.

In the above preferred embodiment, padding is provided at 8 points each on cylinder 21B and operating knob 26. However, padding can be disposed at 3 or more points with equal central angles to the center axis of cylinder 21B and operating knob 26. This achieves the same effect as above described.

In the illumination-type rotary variable resistor in the preferred embodiment, resistor slider 27 slides on resistance film 24A and on conductive film 24B when operating knob 26 is rotated. At this point, a predetermined resistance is gained from terminal 25 electrically coupled to resistor slider 27. In addition, surface-mount LED 31 emits light when the current passes through anode conductive film 23A, anode slider 28, cathode slider 29, and cathode conductive film 23B. Accordingly, the light clearly indicates the operating position of the operating knob 26.

Figure 8:
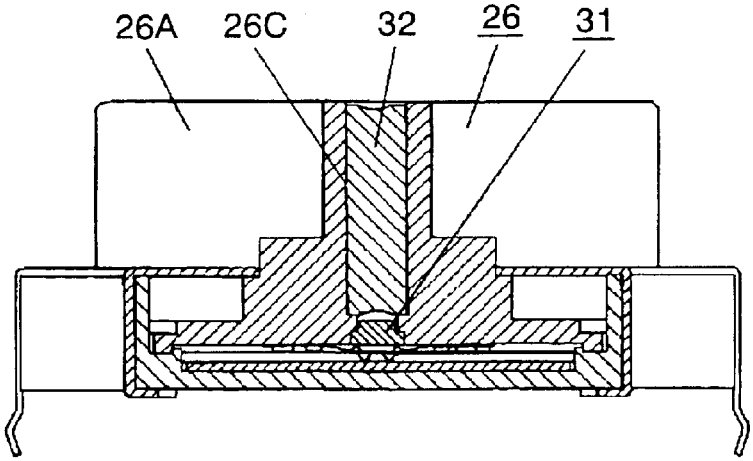
FIG. 8 is a sectional view of a key part of the illumination-type rotary variable resistor in accordance with the preferred embodiment of the present invention, which shows, in its center portion, a section where a transparent bar is fitted to a LED through hole.
Figure 9:
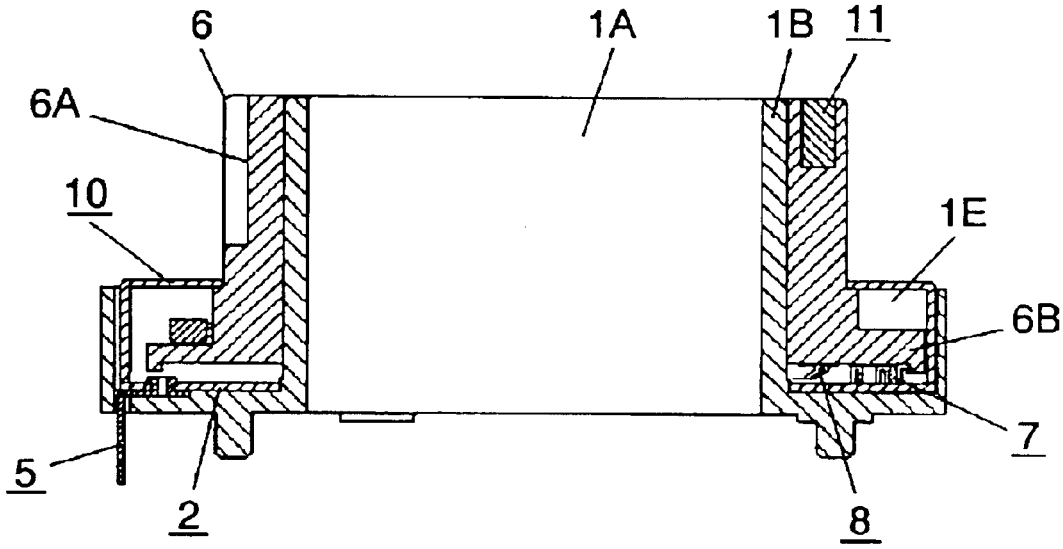
FIG. 9 PRIOR ART
FIG. 9 is a side sectional view of a conventional rotary variable resistor with built-in LED.
Figure 10:
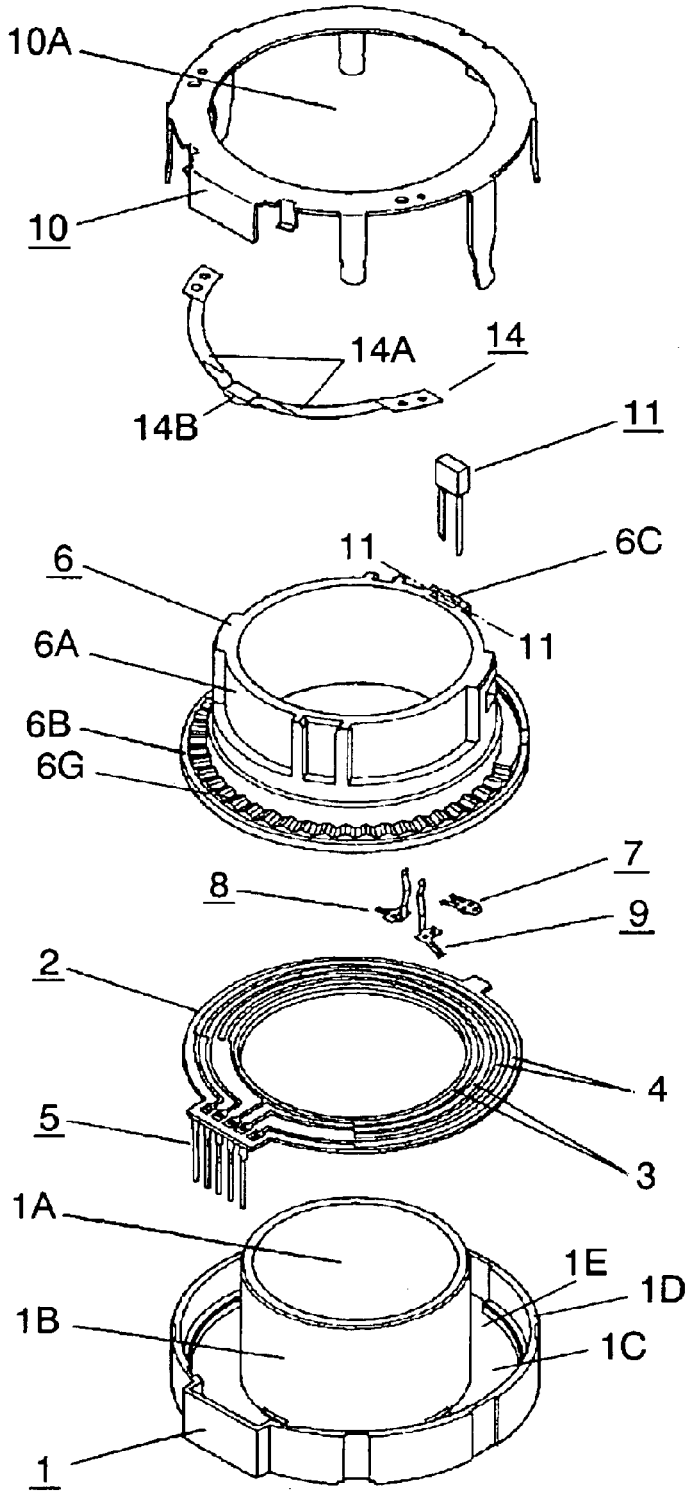
FIG. 10 PRIOR ART
FIG. 10 is an exploded perspective view of the conventional rotary variable resistor with built-in LED.
Figure 11:
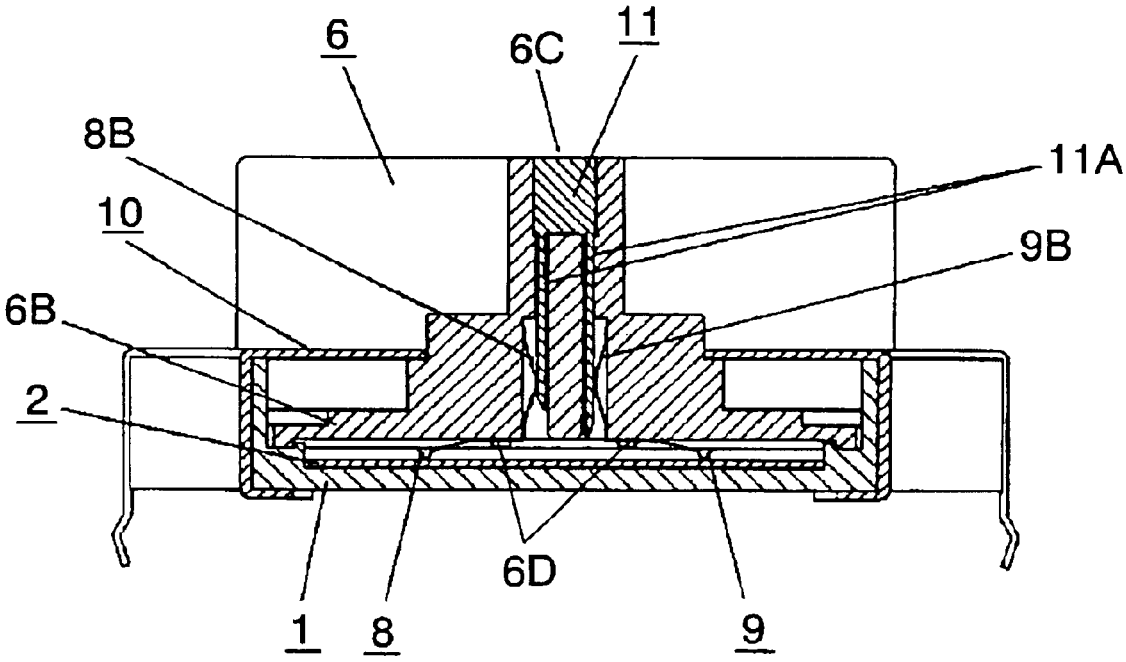
FIG. 11 PRIOR ART
FIG. 11 is a sectional view of a key part of the conventional rotary variable resistor with built-in LED showing a section taken along Line 11—11 in FIG. 10 in its center portion.
Figure 12:
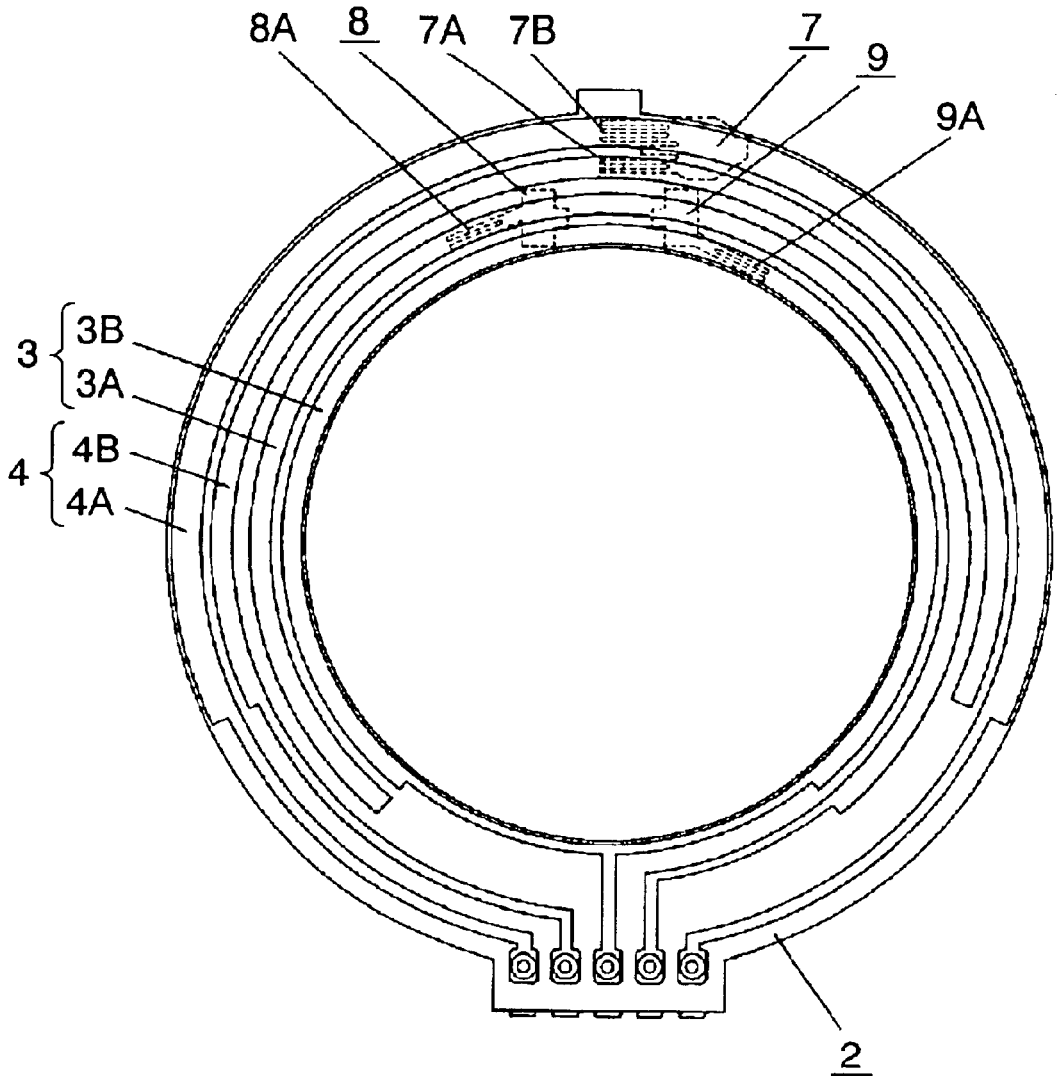
FIG. 12 PRIOR ART
FIG. 12 is a plan view illustrating the relation of the insulating substrate and slider of the conventional rotary variable resistor with built-in LED.

FIG. 8 is a sectional view of a key part where a transparent bar is fitted to the LED through hole.

As shown in FIG. 8, bar 32 made of a transparent material such as acryl is fitted and anchored to LED through hole 26C in the upper part of LED 31 attached to the bottom end of LED through hole 26C of operating knob 26, which is the end facing in the second direction. This leads the light from LED 31 efficiently to the top of operating member 26A. The present invention thus offers an illumination-type rotary variable resistor that indicates the rotating position even more brightly.

As described above, in the present invention, the surface-mount LED is fitted at the bottom end of the LED through hole created in the cylindrical operating member of the operating knob. Further, the contact of the LED slider resiliently contacts the electrode on the bottom face of the LED by fixing the LED slider on the bottom face of the flange of the operating knob. Accordingly, preparations, such as cutting the LED terminal, are eliminated, and attachment of the LED and the LED slider is facilitated. The present invention thus offers an illumination-type rotary variable resistor with reliable quality and fewer assembly steps.

What is claimed is:

1. An illumination-type rotary variable resistor comprising:

(a) a housing including:
- a round bottom plate;
- a cylinder attached to an inner radius of the bottom plate, and protruding in a first direction along a center axis of the cylinder, and
- a cylindrical outer wall surrounding the bottom plate, and protruding in the first direction;

(b) an annular insulating substrate housed in the housing facing the bottom plate, the annular Insulating substrate being provided with a resistor film and an LED conductive film on a surface which is facing in the first direction;

(c) an insulating resin operating knob including:
- a cylindrical operating member having a through hole passing through in the first direction, and being rotatably fitted with an outer radius of the cylinder, and
- a flange attached to the operating member at a side of a second direction being an opposite direction to the first direction, the flange being provided with a resistor slider and an LED slider on a face which is facing in the second direction;

(d) a cover attached to the housing and covering the flange; and (e) a surface-mount LED fitted at an end of the through hole in the second direction;

wherein the resistor slider slidably and resiliently contacts the resistor film, a first contact of the LED slider resiliently contacts an electrode of the surface-mount LED, and a second contact of the LED slider slidably and resiliently contacts the LED conductive film;

wherein the resistor film is formed annularly centering on a center axis of the annular insulating substrate, a cross point of a line passing the through hole along the first direction and the insulating substrate exists between an inner-radius end and an outer-radius end of the resistor film and the LED conductive film is disposed on the outer radius of the resistor film concentrically.

2. The illumination-type rotary variable resistor as defined in claim 1, wherein the end of the through hole in the second direction is formed conforming to an outline of the surface-mount LED, and a part of the end in the second direction is flattened so as to anchor the LED.

3. The illumination-type rotary variable resistor as defined in claim 1, wherein the LED conductive film is disposed deviating with a rotating direction thereof against the center axis of the insulating substrate, with respect to the resistor film, for an angle equivalent to that formed by the contact of the resistor slider and the second contact of the LED slider with respect to the center axis of the insulating substrate.

4. The illumination-type rotary variable resistor as defined in claim 1, wherein a plurality of the second contacts of the LED slider are provided for the LED conductive film, and the plurality of the second contacts resiliently contact the LED conductive film.

5. The illumination-type rotary variable resistor as defined in claim 1, wherein paddings are provided at three points at minimum on an outer face of the cylinder at a position in one of the first direction and the second direction, and at three points at minimum on an inner face of the operating member the paddings being provided at adjacent positions with equal center angles to an center axis of the cylinder, and the cylinder and the operating member contacting at the paddings.

6. The illumination-type rotary variable resistor as defined in claim 1, wherein a transparent material is fitted in the through hole at a portion in the second direction side of the LED.

7. The illumination-type rotary variable resistor as defined in claim 1, wherein the end of the through hole in the second direction is formed conforming to an outline of the surface-mount LED, and a protrusion provided at the end in the second direction is flattened and deformed so as to anchor the LED.

8. An illumination-type rotary variable resistor comprising:

(a) a housing including:
- a round bottom plate;
- a cylinder attached to an inner radius of the bottom plate, and protruding in a first direction along a center axis of the cylinder, and
- a cylindrical outer wall surrounding the bottom plate, and protruding in the first direction;

(b) an annular insulating substrate housed in the housing facing the bottom plate, the annular insulating substrate being provided with a resistor film and an LED conductive film on a surface which is facing in the first direction;

(c) an insulating resin operating knob including:
- a cylindrical operating member having a through hole passing through in the first direction, and being rotatably fitted with an outer radius of the cylinder, and
- a flange attached to the operating member at a side of a second direction being an opposite direction to the first direction, the flange being provided with a resistor slider and an LED slider on a face which is facing in the second direction;

(d) a cover attached to the housing and covering the flange; and (e) a surface-mount LED fitted at an end of the through hole in the second direction;

wherein the resistor slider slidably and resiliently contacts the resistor film, a first contact of the LED slider resiliently contacts an electrode of the surface-mount LED, and a second contact of the LED slider slidably and resiliently contacts the LED conductive film, wherein the end of the through hole in the second direction is formed conforming to an outline of the surface-mount LED, and a protrusion provided at the end in the second direction is flattened and deformed so as to anchor the LED.

* * * * *